US005158816A

United States Patent [19]

Rausing

[11] Patent Number: 5,158,816

[45] Date of Patent: Oct. 27, 1992

[54] PACKING MATERIAL AND PACKING CONTAINERS MANUFACTURED FROM THE MATERIAL

[75] Inventor: Hans Rausing, Wadhurst, England

[73] Assignee: Tetra Pak Holdings SA, Pully, Switzerland

[21] Appl. No.: 387,284

[22] Filed: Jul. 31, 1989

[30] Foreign Application Priority Data

Aug. 1, 1988 [GB] United Kingdom ..... 8818242

[51] Int. Cl.[5] ..... B65D 65/38; B65D 5/02; B32B 15/08

[52] U.S. Cl. ..... 428/35.8; 428/43; 428/152; 428/156; 428/172; 428/330; 428/337; 428/349; 428/461; 428/121; 428/192; 229/140; 229/193; 229/199; 229/DIG. 4

[58] Field of Search ..... 428/43, 152, 156, 461, 428/172, 349, 35.8, 330, 337

[56] References Cited

U.S. PATENT DOCUMENTS 3,142,599 7/1964 Chavannes ..... 156/210
3,727,825 4/1973 Troth .
3,907,193 9/1975 Heller .
4,386,926 6/1983 Heller .
4,507,348 3/1985 Nagata et al. ..... 428/172

FOREIGN PATENT DOCUMENTS 35543 5/1973 Australia .
84694 9/1975 Australia .
734018 11/1969 Belgium .
4614710 7/1989 U.S.S.R. .
19107 of 1915 United Kingdom .
1142773 2/1969 United Kingdom .
1174287 12/1969 United Kingdom .
1200190 7/1970 United Kingdom .
1554144 5/1979 United Kingdom .
1554149 10/1979 United Kingdom .

*Primary Examiner*—P. C. Sluby
*Attorney, Agent, or Firm*—Nixon & Vanderhye

[57] ABSTRACT

A flexible material comprises a sheet or web of deformable heat-sealable plastic material having at least one face a surface relief pattern comprising a multitude of small, closely spaced depressions and/or elevations serving to impart increased rigidity and optionally one or more layers, e.g. of aluminum foil, laminated to said plastic material over said relief pattern.

17 Claims, 2 Drawing Sheets

PACKING MATERIAL AND PACKING CONTAINERS MANUFACTURED FROM THE MATERIAL

FIELD OF THE INVENTION

The present invention relates to a flexible material in sheet or web form for conversion to packing containers. The invention also relates to a packing container and/or a part thereof manufactured from the material.

BACKGROUND TO THE INVENTION

In packing technology packages of a non-returnable kind have been used for a long time for the packing and transporting of, among other things, liquid foodstuffs such as milk, juice etc. A very large group of these known so-called non-returnable packages are manufactured from a material comprising a carrier layer of paper or cardboard with outer and inner coatings of thermoplastics. The material in these packages is often also provided with a further layer of other material, e.g. Al-foil or plastic coatings other than those mentioned here.

The choice of the composition of the packing material is based on the wish to create the best possible protection for the product which is to be packed, while at the same time giving the package sufficient mechanical strength and durability to enable it to withstand such external stresses as the package is subjected to in normal handling. To achieve mechanical rigidity, which on the one hand gives mechanical protection to the product and on the other hand makes it possible for the package to be dimensionally stable so that it can be handled without difficulty and manually gripped, the material in these packages is frequently provided with a relatively thick carrier layer of paper or cardboard. Such a material, however, possesses no tightness properties towards either liquids or gases and the rigidity of the material aimed at is quickly lost when it is subjected to moisture or liquid. To impart the required liquid tightness to the material, the carrier layer is provided therefore, frequently on both sides, with a liquid-tight coating of plastics material and, if this plastics material is a thermoplastics, the coating can also be used for sealing the plastics coatings to one another by so-called heat-sealing. In this manner packages can be sealed and made durably permanent in their intended shape by heat-sealing together thermoplastics-coated, overlapping material panels in a liquid-tight and mechanically durable sealing joint.

Non-returnable packages of the type referred to here are manufactured at present with the help of modern, rational packing machines which form, fill and close finished packages at a high rate of production from a web or from prefabricated blanks of a packing material. From a web, for example, packages are manufactured by joining together the longitudinal edges of the web in an overlap joint so as to form a tube. The tube is filled with the intended contents and is divided into closed package units by repeated flattening and sealing of the tube at right angles to the longitudinal axis of the tube. Subsequently the packing units are severed from one another by means of cuts in the transverse sealing zones, and they are given the desired geometrical shape by further folding and sealing.

During the manufacture of packages in the manner described above the laminated material is subjected to stresses which will be particularly great when the material is folded, since, owing to the relatively great material thickness of the carrier layer, a folding implies that the one plastics coating is subjected to a strong stretching, whereas the other plastics coating is compressed to a corresponding degree along the folding line. Thanks to a great extensibility of the plastic coatings, such folding of the material only rarely leads to breaks or other damage causing leakage in the extended plastics coating, but the problem is aggravated if the packing material also comprises an aluminium foil which compared with the plastics layers has a much smaller extensibility and consequently tends to fracture when the material is folded.

Even if a single 180° folding of the material normally does not have any serious consequences, considerable difficulties arise if the material is to be folded along two crossing crease lines (so-called crosses). This is often the case in external sealing areas which occur on this type of package, whether they are manufactured from a web or from prefabricated blanks. The sealing generally is carried out by heating to melting the plastic coating facing towards the inside of the package along the edge zones which are to be sealed to one another, whereafter the heated plastic coatings are pressed to each other so as to form a sealing fin on the outside of the package held together through fusion of the material. Such a sealing fin comprises double material layers, and to ensure that it does not form an obstacle, the sealing fin frequently is folded down to lie flat against the outside of the package, which means that one of the material layers of the sealing fin undergoes a 180° folding over, and that the package wall in the region of the folded-down sealing fin comprised three material layers, that is to say, has a threefold material thickness. Such a sealing fin often runs along one or more side faces of the package, and since these side faces during the shaping of, for example, parallelepipedic packages are subjected to a 180° folding along a crease line at right angles to the sealing fin, the material thickness in certain regions of the package will go up to 6 times the laminate thickness. At this 180° folding transversely to the sealing region, the material layers located outermost will be subjected to very strong tensile stresses with accompanying extensions and increased risks of crack formations connected therewith in the material. These tensile stresses frequently are so great that cracks occur not only in the aluminium foil included in the material but also in the thermoplastic coatings with accompanying leakage of the packed liquid, which can be absorbed readily by the carrier layer exposed owing to the crack formation, thus impairing the good rigidity in the material.

Disadvantages of the type described above, and which may be ascribed to a very large extent to the moisture-sensitive paper or cardboard layer of the conventional packing material, which at the same time has to be made relatively thick so as to impart the necessary mechanical rigidity to the packing container manufactured, may be avoided with the help of a packing material in accordance with the present invention.

BRIEF DESCRIPTION OF THE INVENTION

The present invention provides a flexible packing material comprising a sheet or web of deformable, heat-sealable, plastics material provided on at least one face by plastic deformation thereof with a relief pattern comprising a multitude of closely spaced depressions and/or elevations to impart increased rigidity to the packing material. The packing material may be a laminate in which the plastics material acts as a carrier layer.

In accordance with the invention it thus has been found that the rigidity of a packing material comprising a carrier layer of deformable, heat-sealable plastics material can be improved considerably if at least one of the sides of the carrier layer is provided with a relieflike surface pattern produced through plastic deformation of the said side of the carrier layer. In particular it has been found that a packing material in accordance with the invention, at comparable material thicknesses, presents a flexural resistance which is appreciably better, 30% or even higher, than the flexural resistance of the packing material comprising a non-patterned, that is to say plain, carrier layer of the same material. A certain part of the dimensional rigidity achieved in accordance with the invention may be assumed to be due to the deformable plastics material during such a plastic deformation for the formation of the said surface pattern undergoing a molecular orientation on stretching contributing to increase rigidity.

The material for the carrier layer may consist appropriately of a thermoplastics which through the addition of mineral grains such as calcium carbonate, calcium sulphate talc, mica etc. obtains a good material rigidity. At the same time, the quantity of the thermoplastics used can be made less, and the material costs consequently can be reduced. A particularly advantageous thermoplastics material in accordance with the invention consists of a polypropylene material, e.g. a homopolymer or copolymer of polypropylene with a melt flow index of from 0.5 to 5, according to ASTM, e.g. a polypropylene - polyethylene copolymer, preferably containing a suitable filler such as a calcium salt, e.g. calcium sulphate or calcium carbonate, in a quantity between 50 and 80, preferably 65–70%.

The relief pattern may take the form of valleys bounded by ribs. The valleys and ribs may run parallel, the ribs may intersect one another so that the valleys are broken up into separate cells. Thus the relieflike rigidity-imparting surface pattern of at least one side of the carrier layer may comprise for example, raised surface portions or ridges crossing one another, or mutually connected, which delimit intermediate, more deeply situated surface panels of mutually identical or similar, regular geometrical shape, e.g. squares, pentagons, hexagons etc.

The width of such more deeply situated surface panels forming the floor of the valleys or cells referred to above is preferably no more than 10,000 μm, more preferably no more than 5,000 μm. Optionally, said width may be no more than 3,000 μm. The length of such valleys and cells may be limited only by the dimensions of the packing material but such cells may preferably have a length no more than five times their width, more preferably no more than three times their width. Preferably, the width of said valleys or cells is no less than 10 μm, more preferably no less than 100 μm, e.g. no less than 500 μm.

To facilitate folding of the packing material in accordance with the invention during manufacture of packing containers, the material appropriately may be provided with an arbitrary pattern of crease lines (narrow, plane weakening zones) which are formed by the surface pattern being interrupted or omitted along corresponding areas of the packing material.

When the surface-pattern side of the carrier layer is intended to be facing towards the inside of the finished packing container, the patterned side of the carrier layer also has plane surface portions along such regions of the packing material as are intended to be joined together and sealed to one another during the manufacture of the said container, as a result of which preconditions for achieving mechanically durable and liquid-tight seals along the said regions are appreciably improved.

BRIEF DESCRIPTION OF THE DRAWINGS

The invention will be illustrated by the following detailed description of preferred embodiments thereof with special reference to the attached drawings, wherein.

DETAILED DESCRIPTION OF PREFERRED EMBODIMENTS

Figure 1:
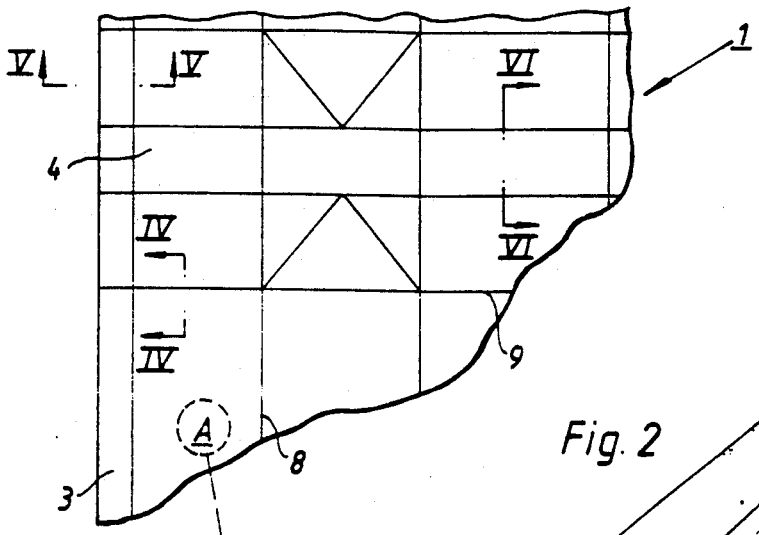
FIG. 1 shows an edge region of a weblike packing material in accordance with the invention.
Figure 2:
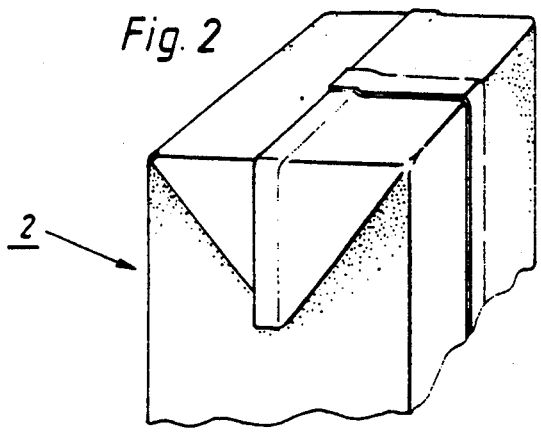
FIG. 2 shows the top part of a packing container manufactured from the packing material in FIG. 1.

FIG. 1 thus shows a part corresponding to an edge portion of a weblike coherent material 1 in accordance with the invention which in the example chosen here is intended to be converted to parallelepipedic packages 2 of the type which is represented in FIG. 2. As mentioned previously, packages 2 are manufactured by joining together the two longitudinal edge zones 3 (whereof only one is shown in FIG. 1) in an overlap joint so as to form a tube which is then filled with the intended contents. The filled tube is divided subsequently into individual packing units by means of repeated flattening and sealing of the tube along narrow transverse zones 4 at right angles to the longitudinal axis of the tube. The packing units finally are separated from one another by cuts in the transverse sealing zone 4 and are given the desired final shape by means of a further forming and sealing operation.

Figure 3:
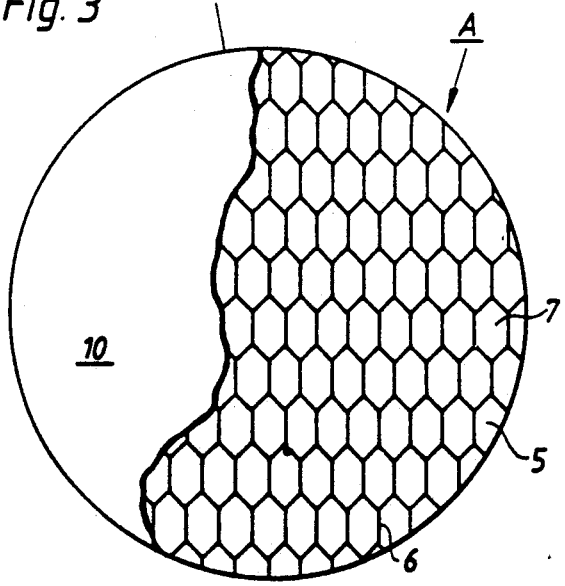
FIG. 3 shows in strong enlargement a ringed, partly exposed region of the material in FIG. 1.

Material 1 in accordance with the invention comprises a carrier layer 5 (FIGS. 3–6) of deformable, heat-sealable plastics material, preferably a polypropylene-polyethylene copolymer of the type mentioned earlier containing between 50 and 80, preferably 65–70% calcium carbonate or calcium sulphate. The carrier layer 5 is provided on the one side, e.g. the side which is intended to be facing towards the inside of the package 2, with a relieflike surface pattern comprising raised surface portions 6 crossing one another or being mutually connected, which between them delimit more deeply located surface panels 7 which, for example, may be of the hexagonal shape shown in FIG. 3. A surface pattern of this type imparts further rigidity to the carrier layer 5 and improves the preconditions for manufacturing packages 2 of good dimensional rigidity from the material 1. The shape of the more deeply located surface panels 7 formed by the plastic deformation of the said side of the carrier layer 5 is not critical, however, but in the small dimensions here in question may vary and also assume other suitable shapes, e.g. square ones. In the case of relatively larger dimensions, though, it has been found that a relieflike surface pattern of pentagon-shaped, intermediary surface panels may be preferred to a surface pattern of the said hexagonal or square shape, since such a pentagonal pattern is quite free of natural weakening lines along which the material might crack when it is subjected to flexural or compressive stresses.

Figure 4:
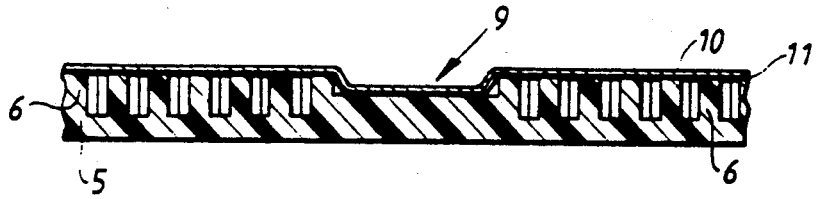
FIG. 4 shows an enlarged cross-section along the line IV—IV in FIG. 1.
Figure 5:
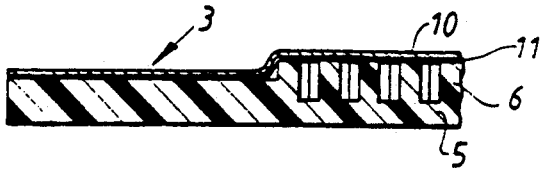
FIG. 5 shows an enlarged cross-section along the line V—V in FIG. 1.
Figure 6:
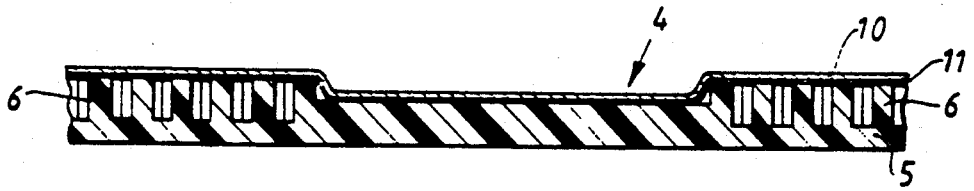
FIG. 6 shows an enlarged cross-section along the line VI—VI in FIG. 1.

As is evident from FIGS. 4 to 6 the raised surface portions or ridges 6 are interrupted or omitted along arbitrary regions of the material 1 so as to form narrow, longitudinal and transverse plane weakening zones 8 and 9 respectively which are intended to facilitate the above mentioned folding of the material 1 on manufacturing of packages.

FIGS. 5 and 6 show, moreover, that the surface-patterned side of the carrier layer 2 along a longitudinal edge zone 3 of the material and along the transverse sealing zone 4, that is to say along the regions of the material which are intended to be joined together and sealed to one another on manufacture of the packages 2, also have plane surface portions freed from relieflike surface pattern in order to make possible a joining together of these regions to lie flat against one another and thereby improve the prerequisites for being able to realise mechanically durable and liquid-tight seals along these regions.

As mentioned earlier, in the example chosen here the surface-patterned side of the carrier layer 5 is intended to be facing towards the inside of the package 2, and in this application of the material 1 it has been found that the increase in rigidity produced by the surface pattern can be further improved if the said carrier layer side is covered by a layer 10 laminated to the carrier layer of a material of a high modulus of elasticity or low extensibility. Such a rigidity-enhancing layer 10 can be constituted, for example, of an Al-foil which, through an intermediary sealing layer 11 of suitable material with good adhesion, possibly may be sealed to the tops of the raised surface portions 6 as well as to the plane surface portions of the carrier layer 5 along longitudinal and transverse sealing zones 3 and 4 respectively of the material. The aluminum foil 10 in this case will lie flat against the tops of the raised portions 6 and function as a spacer element which effectively keeps the distance between these surface portions or ridges and thus counteracts any indentation of the sides of the package 2 when the latter is gripped by hand.

Figure 7:
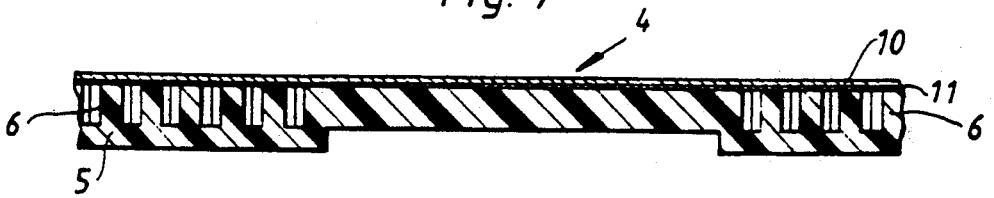
FIG. 7 shows an enlarged cross-section corresponding to FIG. 6 of a material in accordance with a modified embodiment of the invention.

In FIG. 7 is shown a cross-section corresponding to that which is shown in FIG. 6 of a material in accordance with a modified embodiment of the invention, and for the sake of clarity the same reference numerals as previously have been used here for directly comparable details. The material according to FIG. 7 differs from the earlier embodiment in that the plane transverse sealing region 4 is designed so that it lies in the same plane as the tops of the surrounding ridges 6, which further facilitates the formation of strong, liquid-tight transverse seals in the said regions of the packing material on manufacturing of packages. As suggested ealier, the dimensions as well as the shapes of the surface pattern formed may vary, but from practical experiments which have been carried out in accordance with the invention, it has been found that the height of the raised portions or ridges 6 in general ought to be within the range of magnitude 200–800, preferably 300–500 μm, at the same time as the material thickness of the plane surface portions of the carrier layer 5 ought to be within the range of magnitude 50–400, preferably 150–200 μm in order to impart to the material the rigidity aimed at and thereby make possible a manufacture of dimensionally rigid packages which can readily be handled and manually gripped.

Figure 8:
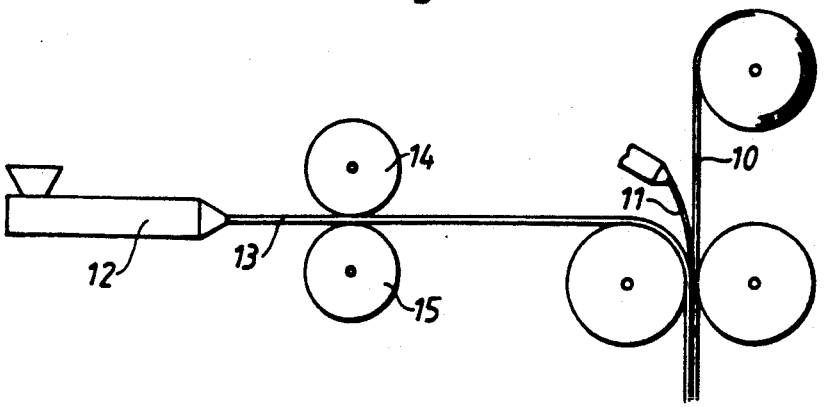
FIG. 8 shows schematically an arrangement for the manufacture of a packing material in accordance with the invention.

The weblike material 1 described above can be manufactured in accordance with the invention with the help of an arrangement of the type which is shown in FIG. 8. With the help of an extruder 12 with a suitably dimensioned sheet die a thermoplastic mass heated to softening or incipient melting (approximately 180–300° C.) is extruded containing a copolymer of polypropylene and polyethylene of a melt flow index of from 0.5 to 5 according to ASTM and containing between 50 and 80, preferably 65–75%, fine-grained calcium salt filler. The extruded plain and still soft film 13, which has a material thickness of between 50 and 400, preferably 150–200 μm, is passed through the nip between co-operating, cooled pressure rollers 14 and 15 whereof the one, 14, on its surface presents a relieflike surface pattern of raised surface portions or matrices which on being pressed against the material film passing through leave a complementary surface pattern formed by plastic deformation on the one side of the film, whereas the other side of the film passes wholly unaffected through the nip of the rollers. After passage through the rollers the patterned side of the film is covered with a thin Al-foil 10 (approximately 10 μm) which, with the help of an extruded intermediary layer 11 of heat-sealable material, is durably joined to the tops of the raised surface portions on the patterned side of the carrier layer and to the plane surface portions located between the patterned portions owing to the combined layers being passed through the nip between a further pair of co-operating, cooled pressure rollers.

I claim:

1. A flexible packing material comprising a sheet or web of deformable, heat-sealable, polyolefin material provided on at least a portion of a face thereof with an integrally formed surface relief pattern comprising a multitude of closely spaced depressions and/or elevations to impart increased rigidity to the packing material wherein the said polyolefin material includes a mineral filler, the quantity of mineral filler being from 50 to 80% of the total weight of the said material so as to increase the rigidity of the material and the surface relief pattern is formed by a process of plastic deformation in order to further increase the rigidity of at least the said portion of the packing material.

2. A packing material as claimed in claim 1, wherein the sheet or web has a thickness of from 200 to 800 μm.

3. A packing material as claimed in claim 1, wherein said sheet or web has a thickness of from 300 to 500 μm.

4. A packing material as claimed in claim 1, wherein the relief pattern is omitted in regions of the packing material to form narrow weakening zones facilitating folding.

5. A packing material as claimed in claim 1, wherein the relief pattern is omitted in regions of the packing material to form plane longitudinal and transverse surface portions of the packing material which are intended to be sealed to one another.

6. A packing material as claimed in claim 5, wherein the said transverse surface portions lie in the same plane as the tops of the adjacent relief pattern.

7. A packing material as claimed in claim 5, wherein the thickness of the material in said plane surface portions is from 50 to 400 μm.

8. A packing material as claimed in claim 7, wherein said thickness is from 150 to 200 μm.

9. A packing material as claimed in claim 1, wherein the relief pattern is formed by ridges crossing one another or being mutually connected.

10. A packing material as claimed in claim 9, wherein the ridges delimit surface panels of lesser thickness and located between the ridges.

11. A packing material as claimed in claim 10, wherein the thickness of the material in said surface panels is from 50 to 400 μm.

12. A packing material as claimed in claim 11, wherein said thickness is from 150 to 200 μm.

13. A packing material as claimed in claim 10, wherein the said surface panels are mutually identical or similar and of regular geometrical shape.

14. A packing material as claimed in claim 1, wherein the mineral-filled thermoplastics is constituted of polypropylene homopolymer or copolymer containing between 50 to 80 percent calcium sulphate or calcium carbonate.

15. A packing material as claimed in claim 14, wherein said percentage is from 65 to 70%.

16. A packing material as claimed in claim 1, wherein the or a surface-patterned side of the carrier layer is covered by a layer of aluminum foil laminated to the carrier layer.

17. A packing container manufactured from a flexible packing material according to claim 1.

* * * * *